United States Patent [19]

Kawai et al.

[11] Patent Number: 4,860,676

[45] Date of Patent: Aug. 29, 1989

[54] WAISTBAND SEW-IN DEVICE

[75] Inventors: Hironao Kawai, Nara; Shigetoshi Fukui, Kadoma; Kenji Ikeda, Neyagawa, all of Japan

[73] Assignee: Morimoto Mfg. Co., Ltd., Shijonawate, Japan

[21] Appl. No.: 167,968

[22] Filed: Mar. 14, 1988

[30] Foreign Application Priority Data

| | | | |
|---|---|---|---|
| May 11, 1987 | [JP] | Japan | 62-70601[U] |
| May 11, 1987 | [JP] | Japan | 62-70602[U] |
| May 11, 1987 | [JP] | Japan | 62-70603[U] |
| May 11, 1987 | [JP] | Japan | 62-70604[U] |
| May 11, 1987 | [JP] | Japan | 62-115394 |

[51] Int. Cl.[4] ..... D05B 3/00; D05B 23/00; D05B 35/04

[52] U.S. Cl. ..... 112/121.14; 112/121.15; 112/121.26; 112/141; 112/147; 112/305; 112/322

[58] Field of Search ..... 112/121.14, 121.15, 112/121.27, 121.26, 141, 147, 153, 305, 318, 322, 2

[56] References Cited

U.S. PATENT DOCUMENTS

| | | | |
|---|---|---|---|
| 3,783,805 | 1/1974 | Guichard | 112/2 |
| 3,839,973 | 10/1974 | Cummins et al. | 112/121.14 |
| 4,098,201 | 7/1978 | Adamski, Jr. et al. | 112/121.26 X |
| 4,098,204 | 7/1978 | Kojima | 112/147 X |
| 4,191,117 | 3/1980 | Della Torre | 112/141 X |
| 4,265,187 | 5/1981 | Torre | 112/121.26 |
| 4,406,087 | 9/1977 | Manetti | 112/121.26 X |
| 4,503,790 | 3/1985 | Keeton | 112/121.27 |
| 4,530,294 | 7/1985 | Pollmeier et al. | 112/121.26 X |

*Primary Examiner*—H. Hampton Hunter

*Attorney, Agent, or Firm*—Jones, Tullar & Cooper

[57] ABSTRACT

A waistband sew-in device to carry out. The sewing of waistbands in the waist part of briefs, skirts and trousers by retaining a cloth in a hoop shape with a stationary frame equipped with an inverted two-legged U-shaped guide surface, inserting a stretched waistband outside the cloth, folding over a cloth edge of the cloth in two plies to the outside of the waistband, further folding the cloth edge of the already folded part in two plies to be pushed into the space between the waistband and the cloth, sliding a belt strip reeled on the guide surface of the stationary frame on the guide surface by a take-up and rewinding mechanism installed on each leg of the two legs of the stationary frame, and sending the cloth having the waistband reeled in its three-folded cloth edge into a sewing unit of a sewing machine together with said waistband.

6 Claims, 13 Drawing Sheets

WAISTBAND SEW-IN DEVICE

BACKGROUND OF THE INVENTION

1. Field of the Invention

This invention relates to a device to sew a hoop rubber or elastic waistband, hereinafter waistband in the waist part of briefs, skirts and trousers.

2. Description of the Prior Art

Sewing waistbands in the waist part of briefs, skirts and trousers was conventionally known as shirring. It was carried out manually by sewing a waistband while stretching and rolling it inside the cloth of the waist part.

Sewing by hand, however, not only took much time but also reduced the production efficiency in spite of the skill and experience required. Besides, the finish tended to be uneven because it was necessary to sew the waistband inside the waist part where it was difficult to check the take-in width and other conditions visually. Such problems were more obviously observed when sewing a waistband by arranging it in the cloth of the waist part folded in three piles than a case of sewing in two plies.

SUMMARY OF THE INVENTION

To solve the above problems, it is hence a primary object of this invention to present a waistband sew-in device capable of stretching and rolling it inside of the cloth of the waistpart automatically and also finishing it uniformly.

It is another object of this invention to present a waistband sew-in device capable of retaining a hoop shape easily during sewing and feeding a cloth securely to a sewing unit of a sewing machines so as not to deflect seams.

It is a different object of this invention to present a waistband sew-in device capable of mounting a waistband automatically on a cloth retained in a hoop shape.

It is still another object of this invention to present a waistband sew-in device capable of folding an edge of a cloth retained in a hoop shape automatically in two plies.

And it is a further different object to this invention to present a waistband sew-in device capable of automatically folding over cloth edge of a folded-over part of a cloth already folded into two plies.

According to one of the features of this invention, a waistband sew-in device comprises a cloth feed mechanism composed of a stationary frame equipped with an inverted-U shaped guide surface to keep a cloth in a hoop shape, a slidable belt strip reeled on the guide surface and a take-up and rewinding mechanism of the belt strip mounted on each one of two legs of the stationary frame, a sewing machine moving reciprocally between an operating position corresponding to the belt strip reeled on the guide surface and a waiting position behind it, a rubber mounting mechanism to insert waistband outside a cloth kept in a hoop shape by the stationary frame in a stretched state, a first cloth edge folding-over mechanism to fold over a cloth edge of the cloth kept in a hoop shape by the stationary frame outside the waistband inserted in the cloth, and a second cloth edge folding-over mechanism to fold over again a cloth edge of the part already folded over by the first cloth edge folding mechanism before a sewing unit of the sewing machine set at the operating position and to press it between the waistband and the cloth.

In such a construction, when an edge of a cloth is inserted in the stationary frame, the cloth is kept in a hoop shape. And when a waistband is mounted outside the cloth in a stretched state by the rubber mounting mechanism, the cloth is pressed against the belt strip reeled on the guide surface of the stationary frame by a shrinking force of the waistband. Accordingly, when the belt strip is slid on the guide surface of the stationary frame by the take-up and rewinding mechanism of the cloth feed mechanism, the cloth is securely fed together with the belt strip. By means of the first cloth edge folding-over mechanism, the waistband is arranged in the cloth folded in two piles, and further arranged in the cloth folded in three plies by the operation of the second cloth edge folding-over mechanism. As a result, by feeding the cloth undergoing the processes of these cloth edge folding-over mechanisms to the sewing machine set at the operating position as described above, the stretching and rolling inside the cloth of the waist part is thus performed.

In this way, the troublsome processes in manual work such as the cloth feeding process, the rubber mounting process and the waistband plating process are automatized and almost all working processes of the stretching and rolling inside the cloth of the waist part can be automatically carried out by relating these processes into a series of flow, so that the workability can be greatly enhanced comparing with the conventional work. It follows not only that the productivity is enhanced but also that the finish becomes uniform because manual processes are reduced.

According to another feature of the present invention, a waistband sew-in device comprises a first take-up and rewinding mechanism composed of a first reel always thrust in a direction to rotate the belt strip and a first feed roller to transfer the belt strip in the first reel by being rotated intermittently in a direction to take up the belt strip in synchronization with the cloth feed mechanism of the sewing machine and whereas to send out the belt strip from the reel by being rotated continuously in a direction to rewind the belt strip, and a second take-up and rewinding mechanism composed of a second reel always thrust in a direction to rotate the belt strip and a second feed roller to send the belt strip into the second reel when the belt strip is let off by the first feed roller, by applying a feed force on the belt strip in the rewinding direction in cooperation with the first feed roller, and to be rotated in the take-up direction following up the belt strip when the belt strip is fed in the take-up direction, by applying a torque in the rewinding direction of the belt strip.

When thus composed, the belt strip reeled on the guide surface of the stationary frame is fed intermittently by always receiving a constant tension at the time of sewing. The cloth fed together with the belt strip is, therefore, securely sent into the sewing unit intermittently by a desired length so that rubber wrinkles of an even density can be produced by the sewing and a preferable stretching and rolling inside the cloth of the waist part can be performed thereby.

According to a different feature of the waistband sew-in device of the present invention, the rubber mounting mechanism has a pair of rubber support pins, which approach and depart with each other in the vertical direction at both right and left sides of said stationary frame, installed on a movable frame reciprocally moving outside the stationary frame.

In such a construction, when the movable frame is moved to project the pins forward to the stationary frame and the waistband is reeled on these pins with these pins close to each other in the vertical direction, and then the pins on which the waistband is reeled are separated from each other in the vertical direction, the waistband is stretched to such an extent that the hoop rubber is inserted in the stationary frame. When the movable frame is withdrawn from this state, the waistband is arranged around the stationary frame. Accordingly, after covering the stationary frame with the cloth, when the waistband is shrunk by bringing the pins close to each other, the waistband is laid on a cloth edge of the cloth kept in a hoop shape.

Since the waistband is sent to the sewing unit of the sewing machine while being stretched and laid on the cloth edge, stretching and rolling inside the cloth of the waist part with an even density of rubber wrinkles can be performed by sewing and its workability can be widely enhanced in comparison with the conventional method. As a result, productivity can be also upgraded and additionally, finishes of the products become uniform because of the reduction of manual processes.

According to a further different feature of this invention, the waistband sew-in device has a first cloth edge folding-over mechanism, which comprises a hook capable of pinching and releasing the cloth edge of the cloth kept in a hoop shape by the stationary frame and a driving mechanism to move the hook closer to or further from the stationary frame, mounted on the movable frame reciprocally moved outside the stationary frame.

Being thus constructed, after inserting the hook beneath the cloth edge kept in a hoop shape by the stationary frame by moving the movable frame forward, when the hook is drawn in to pinch the cloth edge and the movable frame is moved further forward, the cloth edge can be folded over outward. When the movable frame is moreover moved foward, the cloth edge stopped by the hook is completely folded over. That is, the folding-over of the cloth edge can be automated, and the workability can be widely enhanced.

According to still another feature of the present invention, the waistband sew-in device has a second folding-over mechanism which comprises a first guide piece to guide a desired position of the cloth, in which the waistband is inserted, into a direction to draw it apart from the folded-over part when an overlapped part of a folded-over part folded over by the first folding-over mechanism with the waistband is sent to the sewing unit of the sewing machine, and a second guide piece to introduce the cloth edge of the folded-over part between the cloth and the hoop rubber while gradually folding it over.

When composed in such a way, the cloth edge is raised upward by the second guide piece. On the other hand, the cloth is loosened and drawn apart from the folded-over part by the first guide piece. When the cloth is sent out from such a status, the cloth edge is gradually introduced between the cloth and the waistband by the operation of the second guide piece, and pinched by the waistband and the cloth at the outlet to be completely folded in three plies.

Other features and effects of the present invention will be better understood and appreciated from the detailed descriptions of the preferred embodiments taken in conjunction with the accompanying drawings.

DESCRIPTION OF THE PREFERRED EMBODIMENTS

Figure 1:
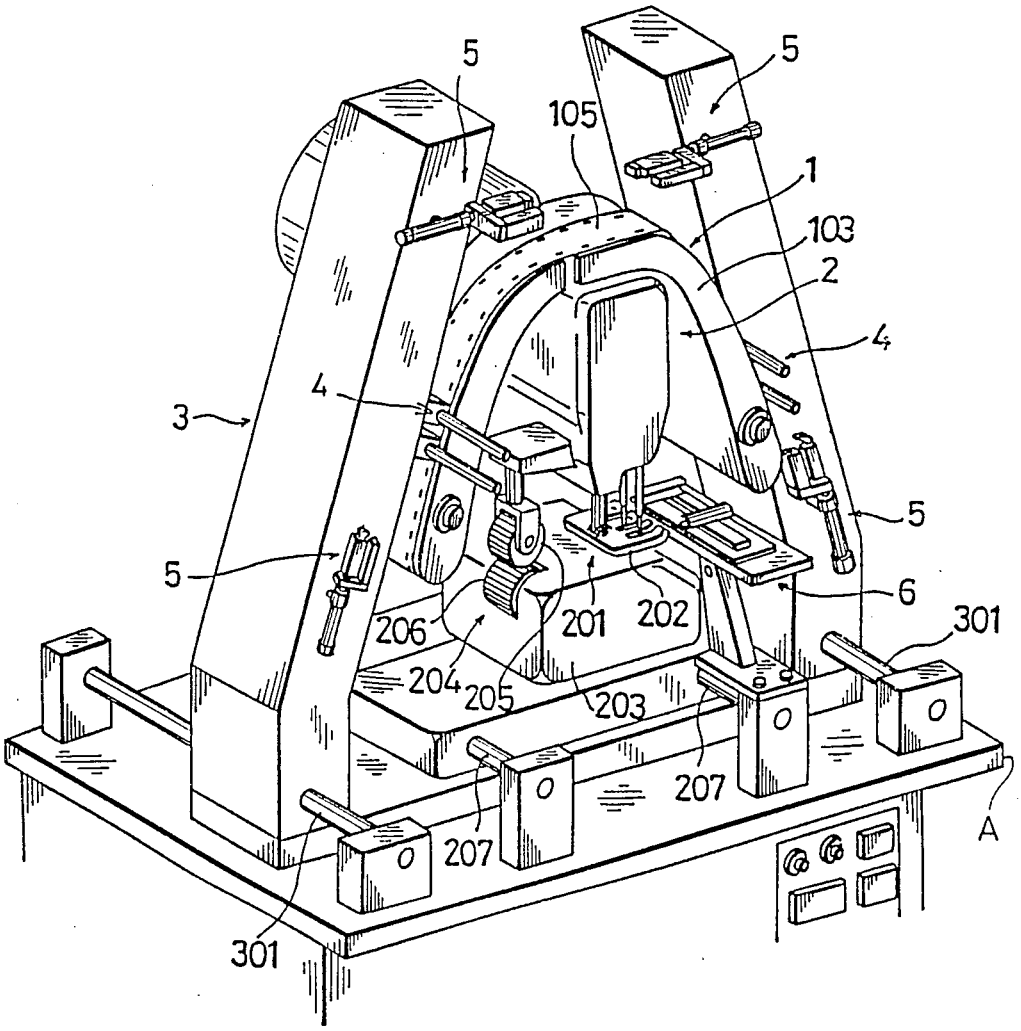
FIG. 1 is a schematic perspective view of a waistband sew-in device according to the present invention.

FIG. 1 is a schematic perspective view of a waistband sew-in device according to the present invention, in which numeral 1 is a cloth feed mechanism, 2 is a sewing machine, 3 is a movable frame, 4 is a rubber mounting mechanism, 5 is a first cloth edge folding-over mechanism, and 6 is a second cloth edge folding-over mechanism. These parts are explained in details hereinafter.

Figure 2:
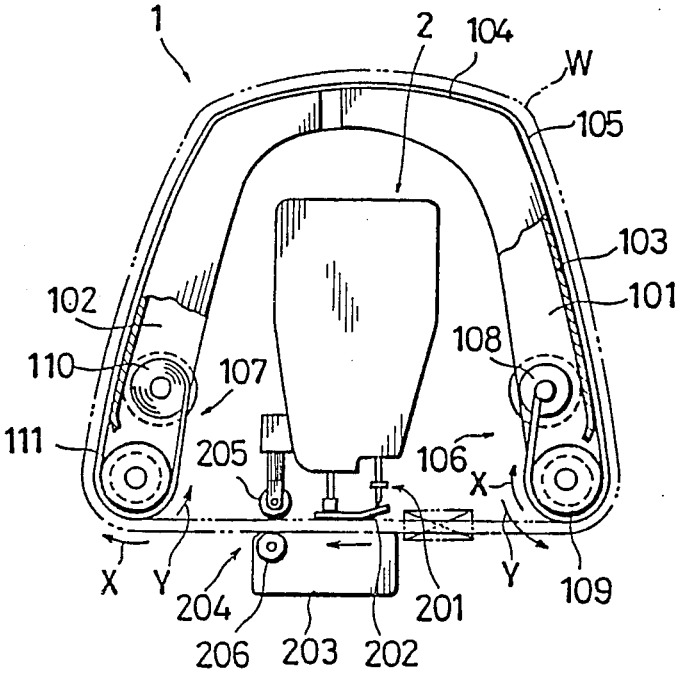
FIG. 2 is a partially cut-away front view of a cloth feed mechanism.
Figure 3:
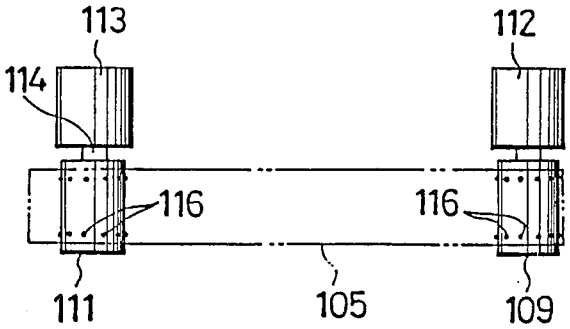
FIG. 3 is a schematic plan of a first and a second take-in and rewinding mechanisms.

FIG. 2 shows an embodiment of the cloth feed mechanism 1 used in the waistband sew-in device in FIG. 1. The cloth feed mechanism 1 shown in the drawing comprises an inverted-U shaped guide surface which is an outer face of a stationary frame 103 having two legs 101, 102, a belt strip 105 reeled slidably on a guide face 104 and take-up and rewinding mechanisms 106, 107 installed on each of the two legs 101, 102. A take-up and rewinding mechanism referred to as a first take-up and rewinding mechanism hereinafter) 106 installed on a leg 101 comprises a first reel 108 and a first feed roller 109, and another take-up and rewinding mechanism referred to as a second take-up and rewinding mechanism hereinafter) 107 mounted on the other leg 102 comprises a second reel 110 and a second feed roller 111. The belt strip 105 is turned around the first reel 108 at an end and turned around the second reel 110 at the other end, and at the same time, reeled on the first feed roller 109 and the second feed roller 111 at two points near take first reel 108 and the second reel 110 respectively. Each of the first reel 108 and the second reel 110 is always thrust in a direction to turn the belt strip 105 by a specific force, which takes up the sent belt strip 105 when the belt strip 105 is sent in, and which is rotated in a let-off direction against the thrusting force when the belt strip 105 is let off. As shown in FIG. 3, the first feed roller 109 and the second feed roller 111 are driven independently by motors 112 and 113. As for motor 112 to drive the first feed roller 109, a stepping motor or a servomotor is used. As for the motor 113 to drive the second feed roller 111, a type of motor in which a rotary torque is applied on its rotation shaft 114 by the friction force of the rotating part is used.

Figure 4:
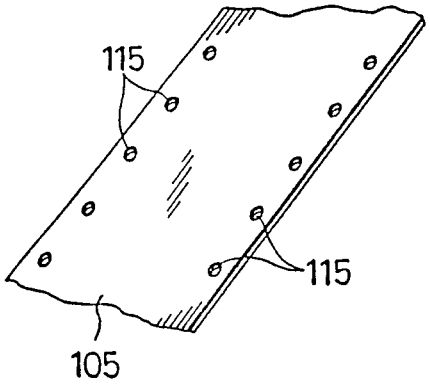
FIG. 4 is a magnified view of a belt strip.
Figure 5:
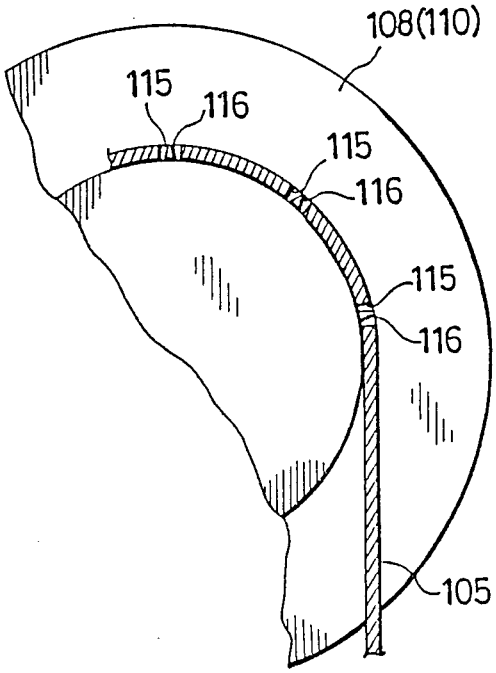
FIG. 5 is a magnified partial view to explain a threading state of the belt strip in regard to a roller.

As shown in FIG. 4, the belt strip 105 is a metallic thin plate having engaging holes 115 on both edges in its widthwise direction at a specific interval, and these engaging holes 115 are designed to be engaged with projections 116 mounted on the first reel 108 or the second reel 110 as shown in FIG. 5.

The sewing machine 2 is of a multi-needle type as shown in FIG. 1 and FIG. 2, and its sewing unit 201 is equipped with a cloth presser 202, a cloth table 203 and others, and at the same time, a cloth feed mechanism 204 comprises a driving side roller 205 and a driven side roller 206. Such a sewing machine 2 by itself is already known.

The stationary frame 103 is fixed on a base plate A, but the sewing machine 2 is designed to reciprocally move back and forth while being guided by a guide rod 207. A position corresponding to the belt strip 105 is set as an operating position and behind it is a waiting position or inoperative positive.

The movable frame 3 is installed so as to surround the stationary frame 103 and to move reciprocally outside the stationary frame 1 when guided by the guide rod 301. On this movable frame 3, the rubber mounting mechanism 4 and the first cloth edge folding-over mechanism 5 described below are mounted.

Figure 6:
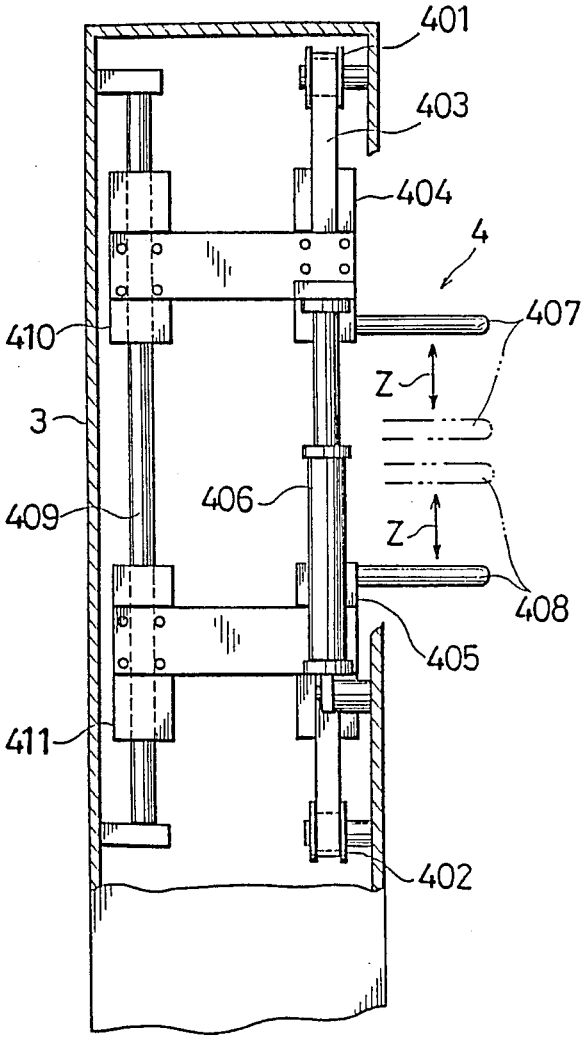
FIG. 6 is a partially cut-away front view of the same rubber mounting mechanism.
Figure 7:
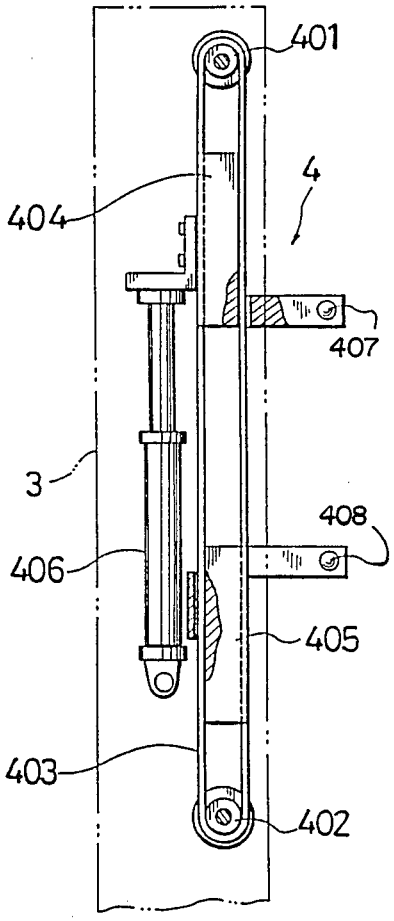
FIG. 7 is a partially cut-away side view of the same rubber mounting mechanism.

FIG. 6 and FIG. 7 show an embodiment of the rubber mounting mechanism 4 used in the waistband mounting device in FIG. 1. The rubber mounting mechanism 4 in these drawings are constructed in such a way as to reel an endless belt 403 on a pair of upper and lower rollers 401 and 402 mounted on the movable frame 3, to fix pin holding members 404, 405 respectively on two points to divide the endless belt 403 equally, to put an air cylinder 406 between either one of these pin holding members 404, 405 and the movable frame 3 and to let the pin holding memebers 404 and 405 hold pins 407 and 408. Numeral 409 is a guide rod, in which sliding members 410 and 411 joined to the pin holding members 404, 405 are inserted slidably.

Figure 9:
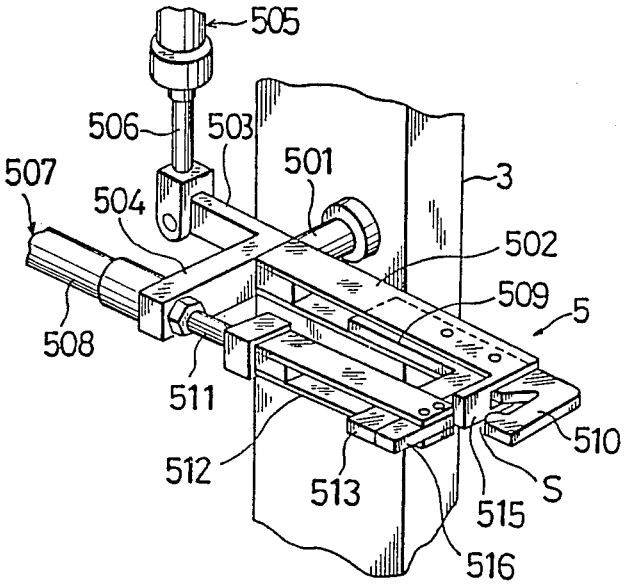
FIG. 9 is a schematic perspective view of a first cloth edge folding-over mechanism.
Figure 10:
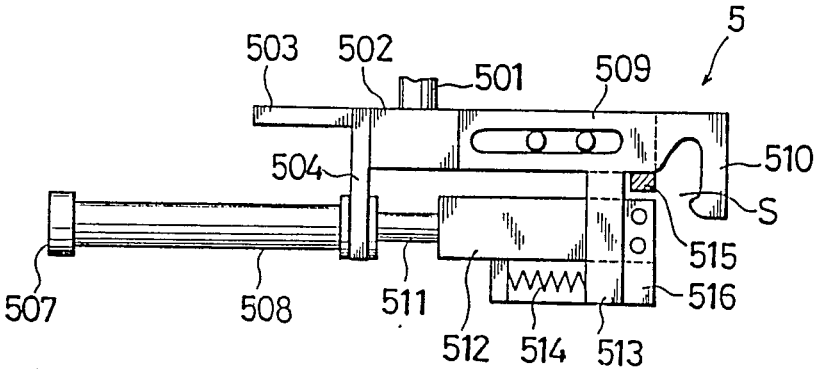
FIG. 10 is a partially omitted plan of the same first cloth edge folding-over mechanism.

FIG. 9 and FIG. 10 show an embodiment of the first cloth edge folding-over mechanism 5 taken in the waistband sew-in device in FIG. 1. The first cloth edge folding-over mechanism 5 of this drawing comprises a guide frame 502 which is oscillatable on the movable frame 3 about a horizontal shaft 501, an air cylinder 505 for oscillation including a piston rod 506 connected to a projecting part 503 of two projecting parts 503, 504 mounted on the guide frame 502, another air cylinder 507 including a cylinder tube 508 mounted on the other projecting part 504, a slider 509 held slidably on the guide frame 502, a hook 510 mounted integrally on an end of the slider 509, and a retractable frame 512 installed on a piston rod 511 of the air cylinder 507, in which a protrusion 513 mounted on the slider 509 is inlaid slidably, and biasis the hook 510 in its projecting direction by means of a spring 514. Numeral 515 is a protrusion situated opposite to the tip of the hook 510, which is mounted on the guide frame 502. Numeral 516 is a stopper mounted on an end of the retractable frame 512.

The first cloth edge folding-over mechanisms 5 are, for example as shown in FIG. 1, is mounted at four points on the movable frame 3, all of which are opposite to four points on the outer surface of the stationary frame 103 respectively.

Figure 13:
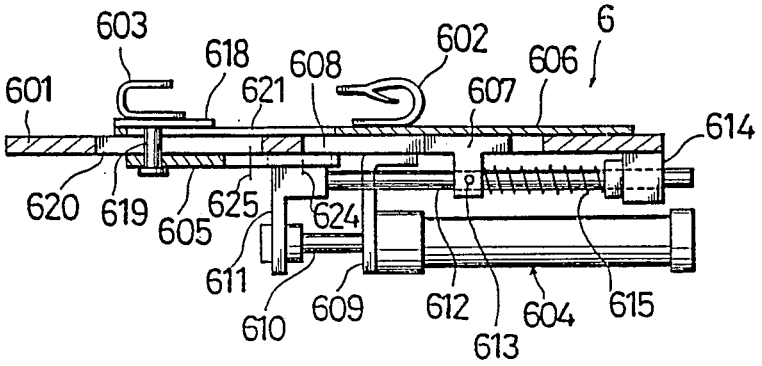
FIG. 13 is a schematic vertical sectional view of a second cloth edge folding-over mechanism.
Figure 14:
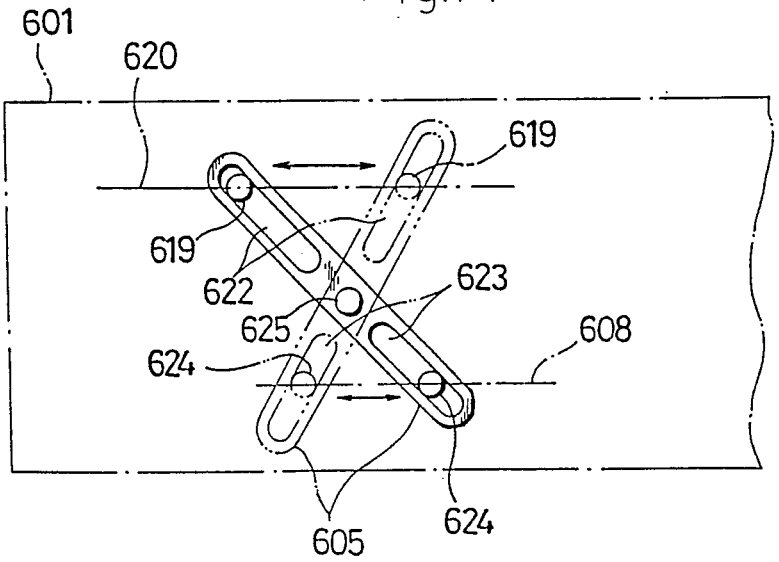
FIG. 14 is a plan view showing a link of the second cloth edge folding-over mechanism.
Figure 15:
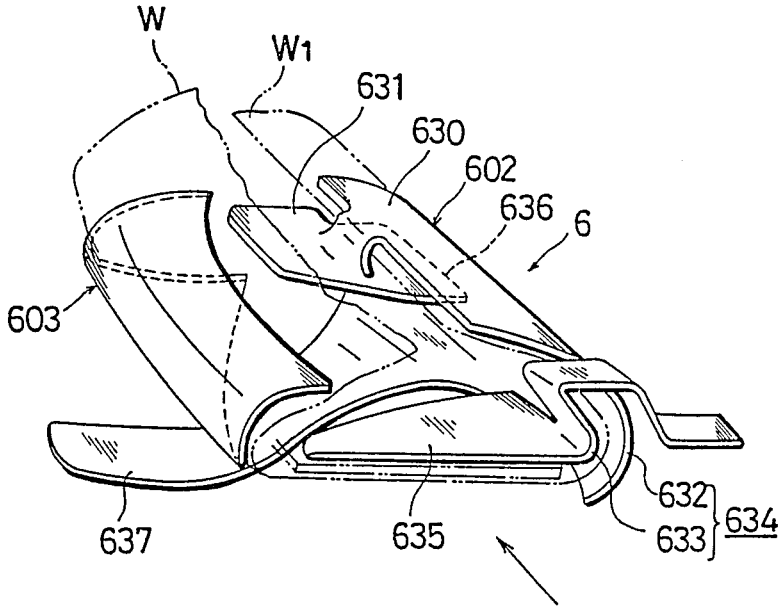
FIG. 15 is a schematic perspective view showing principal parts of the second cloth edge folding-over mechanism.

FIGS. 13 to 15 show an embodiment of the second cloth edge folding-over mechanism 6 employed in the waistband sew-in device. The second cloth edge folding-over mechanism 6 in the drawing comprises a pair of front and rear guide members 602, 603 mounted on slide table 601, and an air cylinder 604 which brings these guide members 602, 603 closer to or further apart from each other and a link 605.

One of the guide members 602 is fixed on a slide plate 606 which is slid on the slide table 601, and a slider 607 fixed on the slide plate 606 is inserted in a slot 608 opened in the longitudinal direction on the slide table 601. On a piston rod 610 of the air cylinder 604 mounted on the back side of the slide table 601 by a fitting 609, the slider 607 is fixed by an end fitting 611 and a connecting rod 612. Numeral 613 shows a setscrew to fix the slider 607 on a connecting rod 612. The connecting rod 612 is extended forward, and the extended portion penetrates a supporting member 614 mounted on the slide table 601, a compression coil spring 615 is inlaid between the supporting member 614 and the slider 607. The other guide member 603 is fixed on a slide plate 618 slid on the slide plate 606, and a pin 619 mounted on the slide plate 618 is inserted in a slot 620 opened on the slide table 601 and a slot 621 opened on the slide plate 606. The pin 619 is stopped in a slot 622 opened in one side of the link 605. In addition, a pin 624 mounted on the end fitting 611 is stopped in a slot 623 opened on the other end of the link 605. Numeral 625 is a supporting shaft to support the link 605.

The guide member 602 comprises, as shown in FIG. 15, a first guide piece 631 mounted on an end of a cloth outlet side on a guide plate 630 curved in a C-shape, a second guide piece 634 composed of a curved part 632 on an end of a cloth inlet side on the guide plate 630 and an oblique rising part 633 opposed to the curved part 632, and a spatula-shaped piece 635 projecting from the bottom end of the oblique rising part 633, on the first guide piece 631, a protruding part 636 protruding inward to the guide plate 630 is mounted. The guide plate 630 is integrally equipped with a tongue 637. The other guide member 603 is composed of a C-shaped plate opposed to the guide member 602.

The operation of the mechanisms described above is explained herebelow.

The cloth feed mechanism 1 acts in the following way.

In FIG. 2, when the first feed roller 109 of the first take-up and rewinding mechanism 106 is intermittently rotated by a stepping motor or a servomotor in synchronism with the feed mechanism 204 of the sewing machine 2 in the take-up direction (arrow X) of the belt strip 105, the belt strip 105 is let off from the second reel 110 of the second take-up and rewinding mechanism 107, and at the same time, the belt strip 105 sent in the take-up direction X by the first feed roller 109 is turned around the first reel 108 by each forwarded portion. At this time, the second feed roller 111 is rotated in the take-up direction X following up the belt strip 105 while applying a torque on the belt strip 105 in a rewinding direction (arrow Y). As a result, the belt strip 105 is taken up intermittently in the first reel 108 in a state subjected to a constant tension.

On the other hand, when the first feed roller 109 is continuously rotated by a stepping motor or a servomotor in the rewinding direction Y of the belt strip 105, the belt strip 105 is continuously let off from the first reel 108. At this time, the second feed roller 111 also feeds the belt strip while applying a torque on the belt strip 105 in the rewinding direction Y. The belt strip 105 is thus sent in the rewinding direction owing to the cooperation of the first feed roller 109 and the second feed roller 111, and the forwarded portion is taken up on the second reel 110.

When the belt strip 105 is intermittently sent in the take-up direction X owing to the take-up and rewinding mechanisms 106 and 107, the sewing machine 2 is set at the operating position, and while the belt strip 105 is sent in the rewinding direction Y due to the take-up and rewinding mechanisms 106 and 107, the sewing machine 2 is set at the waiting position.

Accordingly, when setting the sewing machine 2 at the operating position and feeding the belt strip 105 intermittently in the take-up direction X in synchronization with the cloth feed mechanism 204 of the sewing machine 2 as described above from the state where a cloth W covers the stationary frame 103 and is kept in a hoop shape, the cloth W is intermittently sent together with the belt strip 105 in a state of lying on the belt strip 105, and the parts of the cloth W are successively sent into the sewing unit 201 of the sewing machine 2. In this process, the belt strip 105 cannot be stretched because it is made of a metallic thin plate while the cloth W has a constant tension applied thereto. As a result, the cloth W is securely sent to the sewing unit 201 without being stretched or twisted.

The rubber mounting mechanism 4 acts in the following way.

Figure 8A:
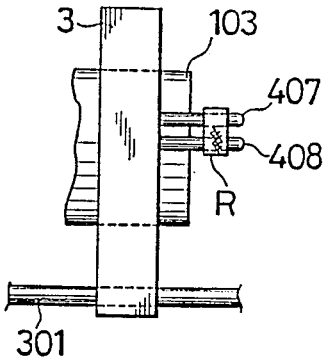
FIG. 8A to 8F are explanatory views of the rubber mounting process.
Figure 8B:
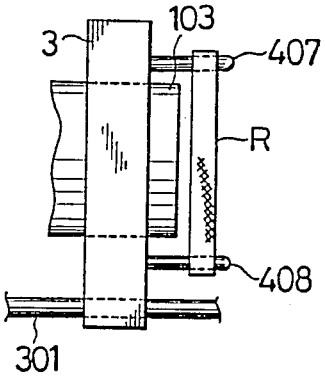
Figure 8C:
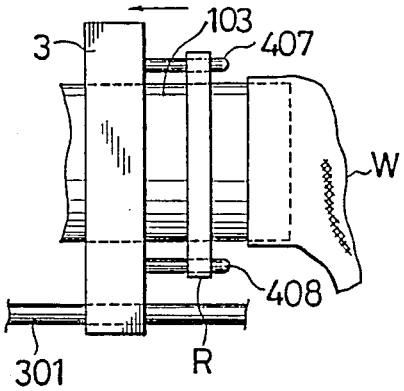
Figure 8D:
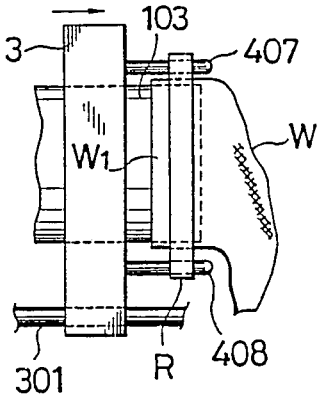
Figure 8E:
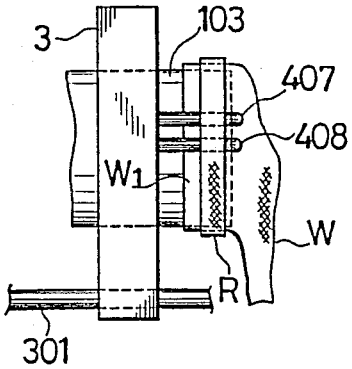
Figure 8F:
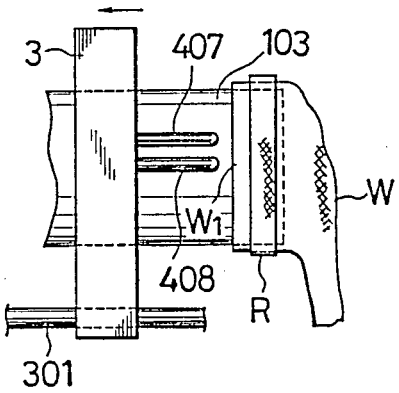

In FIG. 6 and FIG. 7, when the endless belt 403 is rotated by extending or contracting the air cylinder 406, the pins 407 and 408 are brought closer to or further apart from each other in the vertical direction as shown by arrows Z. Additionally, it is possible to project the pins 407 and 408 before the stationary frame 103 as shown in FIG. 1 by moving the movable frame 3 forward and on the other hand, it is possible to withdraw the pins 407 and 408 to the side of the stationary frame 103 by moving the movable frame 3 backward. Therefore, when the movable frame 3 is moved forward as shown in FIG. 8A to project the pins 407, 408 before the stationary frame 103, and a waistband R is reeled on these four pins with these pins 407, 408 brought closer to each other, the pins 407, 408 are separated apart from each other by extending the air cylinder 406 (see FIGS. 6 and 7), and the waistband is stretched as shown in FIG. 8B. Furthermore, when the movable frame 3 is withdrawn while stretching the waistband R to such an extent as to be inserted in the stationary frame 103 in that way, the waistband R is arranged around the stationary frame 103 as shown in FIG. 8C. From this state, the cloth W covers the stationary frame 103 as described above, the movable frame 3 is sequentially moved forward to a desired position as shown in FIG. 8D, so as to arrange the waistband R around the cloth edge $W_1$. Thereafter, when the waistband R is shrunk by bringing the pins 407 and 408 closer as shown in FIG. 8E, the waistband R is laid over the cloth edge $W_1$ and the cloth edge $W_1$ is pressed against the belt strip 105 by a force of the waistband to shrink further. As a result, when the belt strip 105 is sent in the take-up direction X (see FIG. 2) as described before, the cloth W is securely sent together with the belt strip 105. After the waistband R is laid over the cloth $W_1$, the movable frame 3 is moved backward as shown in FIG. 8F, and the pins 407 and 408 are pulled off from the waistband R.

The first cloth edge folding-over mechanism 5 operates in the following way.

In FIG. 9 and FIG. 10, when the air cylinder 507 is extended, the retractable frame 512 advances, and at the same time, the slider 509 thrust by the spring 514 moves forward together with the hook 510, and a clearance S is formed between the hook 510 and the protrusion 515. By contrast, when the retractable frame 512 is withdrawn by contracting the air cylinder 507, the protrusion 513 and the slider 509 are pulled off by the stopper 516, and the hook 510 touches the protrusion 515 to eliminates the clearance S. On the other hand, when the air cylinder 505 is extended or contracted, the guide frame 502 is oscillated around the horizontal shaft 501 and the hook 510 changes its direction. The hook 510 is moreover moved back and forth by changing the position of the movable frame 3 backward and forward.

Figure 11A:
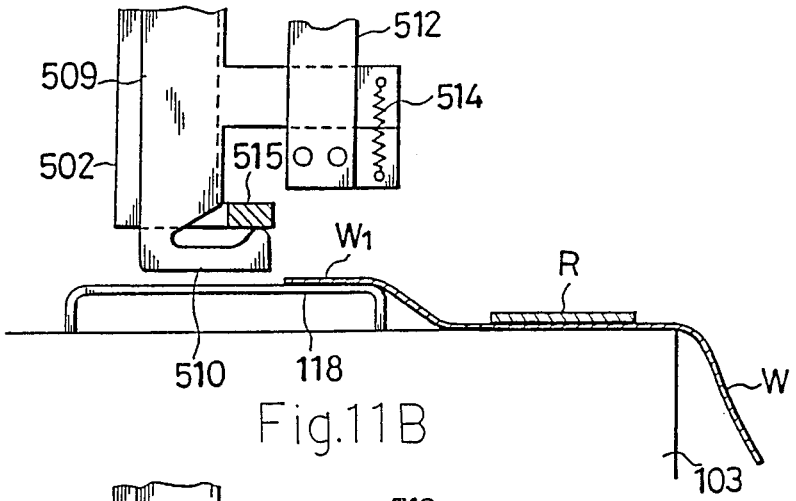
FIGS. 11A to 11G are explanatory views of the process to fold the cloth edge in two plies by the first cloth edge folding mechanism.
Figure 11B:
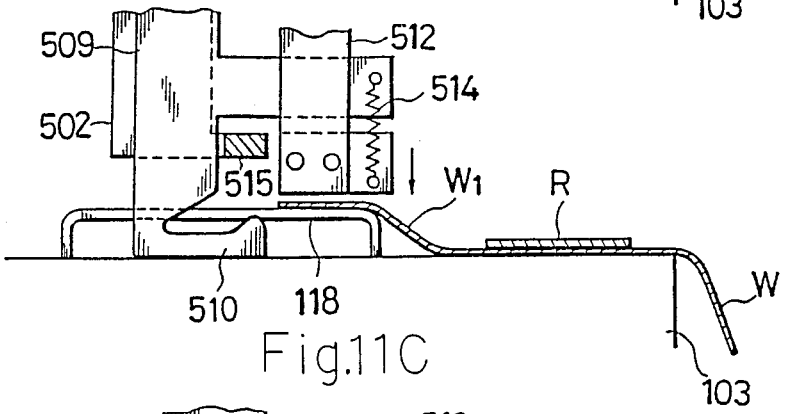
Figure 11C:
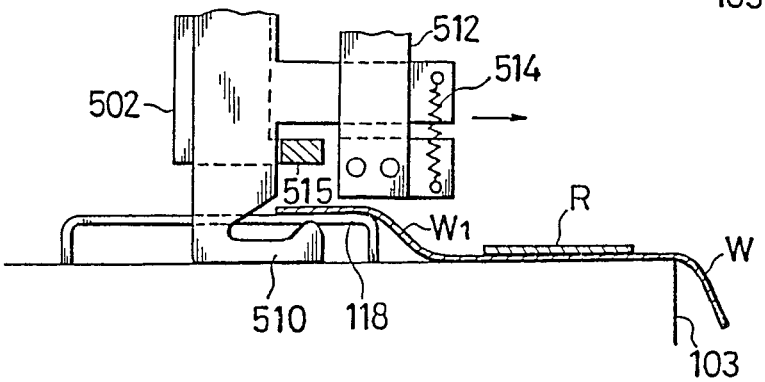
Figure 11D:
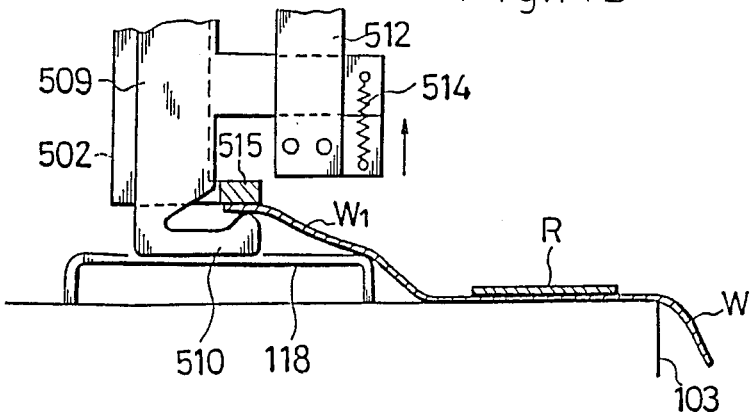
Figure 11E:
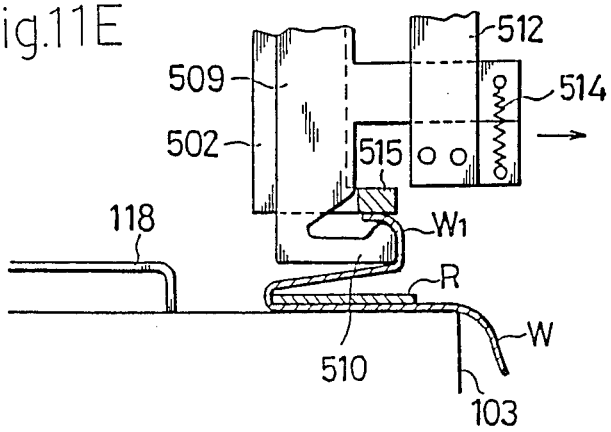
Figure 11F:
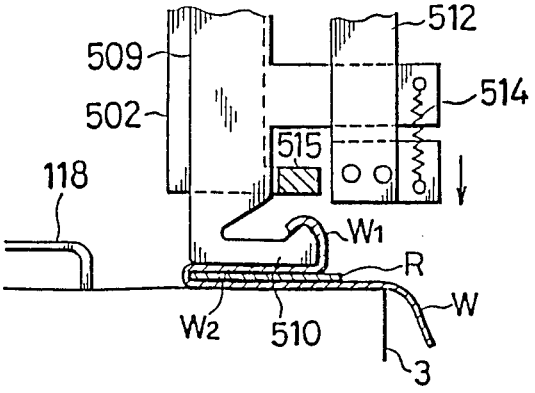
Figure 11G:
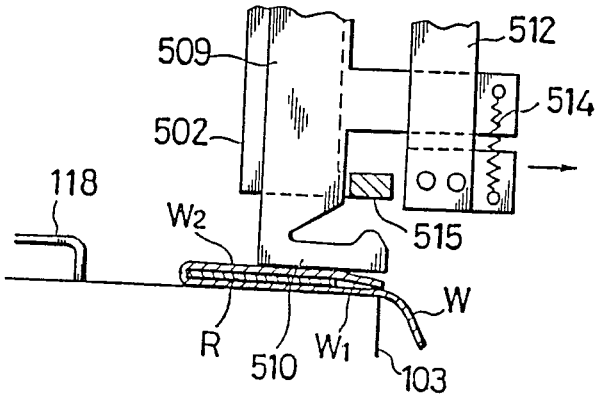

FIGS. 11A and 11G show a process of folding over the cloth edge $W_1$ of the cloth W covering the stationary frame 103 into two plies. The cloth edge $W_1$ is loosened from the stationary frame 103 by a spacer 118 mounted on the stationary frame 103. FIG. 11A shows the state where the hook 510 is adjusted in its direction to confront the stationary frame 103. If the hook 510 is advanced from this state, the hook 510 is elastically pressed against the stationary frame 103 by the force of the spring 514 as shown in FIG. 11B. Next, the hook 510 is inserted beneath the cloth edge $W_1$ by moving the movable frame 103 forward as shown in FIG. 11C, and the hook 510 is pulled in as shown in FIG. 11D so as to pinch the cloth edge $W_1$ with the hook 510 and the protrusion 515. When the movable frame 103 is moved further forward, the cloth edge $W_1$ is folded over to the outside of the waistband R as shown in FIG. 11E. The hook 510 is sequentially advanced to be elastically pushed against the folded part $W_2$ as shown in FIG. 11F, and the movable frame 103 is moved further forward from the state to fold over the cloth edge $W_1$ stopped at the hook 510 completely as shown in FIG. 11G. At this time, the cloth edge $W_1$ should be designed to be projected a little from the waistband R. The cloth edge $W_1$ is consequently folded in two plies. After finishing the process of folding in two plies, the hook 510 is returned to the original state (for example, the state shown in FIG. 1).

Figure 12:
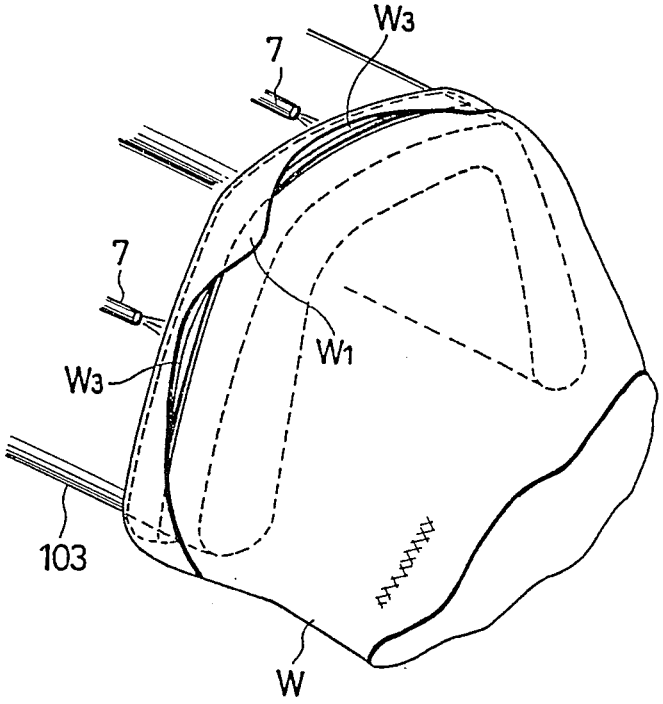
FIG. 12 is a perspective view showing a state to blow off an unfolded part of the cloth by air.

The work to fold the cloth edge $W_1$ in two plies described above is performed at four points on the circumference of the stationary frame 103, but some portion may be nevertheless left unfolded even by such a folding-over process. Such an unfolded portion is perfectly eliminated, for example, by blowing off an air jet from a nozzle 7 as shown in FIG. 12. In FIG. 12, symbol $W_3$ shows an unfolded portion.

The second cloth edge folding-over mechanism 6 works as described below.

The second cloth edge folding-over mechanism 6 is mounted before the sewing unit 201 of the sewing machine 2 in the waistband sew-in device shown in FIG. 1, to which the cloth edge $W_1$ folded in two plies by said first cloth edge folding-over mechanism 5 is sent. The cloth edge $W_1$ is then sent to the sewing unit 201 after being folded in three plies by this second cloth edge folding-over mechanism 6.

Figure 16A:
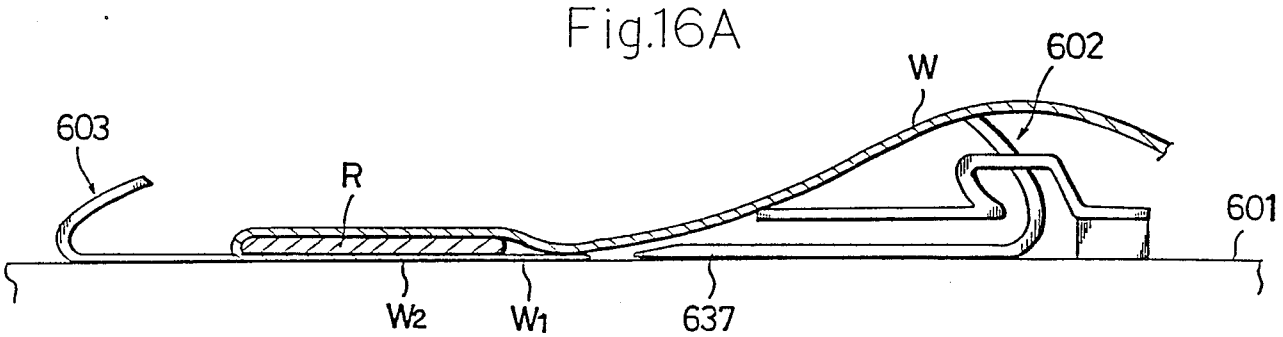
FIGS. 16A and 16B are explanatory views of a process to fold over the cloth edge in three plies by the second cloth edge folding-over mechanism.
Figure 16B:
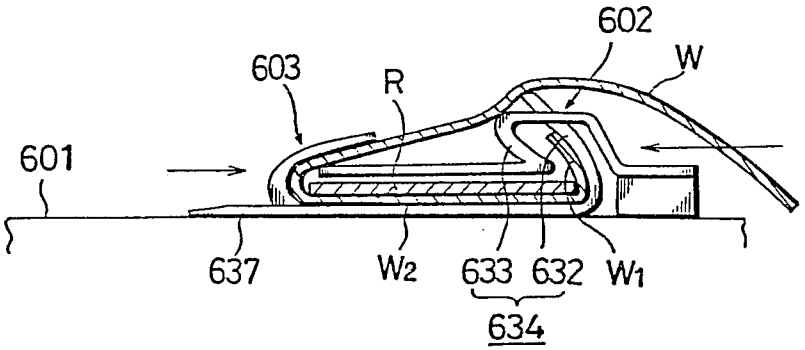
Figure 17:
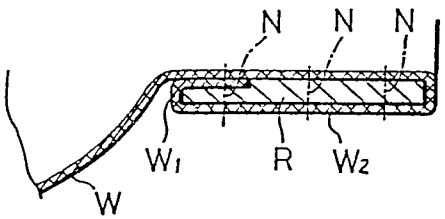
FIG. 17 is a partial sectional view of the cloth in which the hoop rubber is sewn.

At the stage that the cloth edge $W_1$ is folded in two plies, a pair of guide members 602, 603 are separated apart from each other as shown in FIG. 16A, and after finishing the process of folding the cloth edge in two plies, these guide members 602, 603 are brought closer to each other as shown in FIg. 16B. The pair of guide members 602 and 603 are moved closer to or further from each other by the operation of the air cylinder 604. When the guide members 502 and 603 move closer, the folded part $W_2$ of the cloth W positioned on the slide table 601 is scooped up by the tongue 637 as shown in FIG. 16B, and at the same time, the cloth edge $W_1$ projected from the waistband R is raised upward by the second guide piece 634. The cloth W drooped forward from the slide table 601 is furthermore lifted up by the first guide piece 631 to be separated from the folded-over part $W_2$. When the cloth W is intermittently sent from such a state by the cloth feed mechanism 1, the cloth edge $W_1$ is introduced gradually between the cloth W and the waistband R by the operation of the guide plate 630 and the second guide piece 634, and at the outlet of the guide plate 630, the cloth edge $W_1$ is sandwiched between the waistband R and the cloth W and the cloth edge $W_1$ is thus perfectly folded in three plies. The three-folded part formed in such a way is sent to the sewing unit 201 of the sewing machine 2 by the cloth feed mechanism 1 described before, and there ends the process of rubber shirring. FIG. 17 is a sectional view showing the state that the waistband R is sewn in the three-folded part at the sewing unit 201. In the drawing, symbol N denotes the sewing position.

The mechanisms described above in detail are, for example, controlled by a computer and actuated according to its programs. An example is explained herebelow.

Where the cloth W is retained in a hoop shape by the stationary frame 103, the rubber mounting process is performed by the rubber mounting mechanism 4 and the two-ply folding process is carried out by the first cloth edge folding-over mechanism 5, and then, the second cloth edge folding-over mechanism 6 is set before the sewing unit 201 of the sewing machine 2. At this time, the cloth feeding process by the cloth feed mechanism 1, the three-ply folding process by the second cloth edge folding-over mechanism 6 and the sewing process by the sewing machine 2 are simultaneously operated. Sewing by the sewing machine 2 is, however, started after preceedingly feeding the three-folded part of the cloth W for a desired width A for the purpose of surely forming the three-folded state. In addition, right before the folded part in three plies of the cloth W is revolved once by the cloth feed mechanism 1, the guide members 602, 603 of the second cloth edge folding-over mechanism 6 are controlled to be separated from each other so as not to disturb the start of sewing in passing through the space between the guide member 602, 603.

In this way, most all the working processes in the rubber shirring process are automated.

What is claimed is:

1. A waistband sew-in device comprising:

a cloth feed mechanism comprising a stationary frame having two legs defining an inverted-U shaped guide surface for retaining a cloth into a hoop shape, a slidable belt strip reeled on said guide surface, and a take-up and rewinding mechanism mounted on each one of said two legs of said stationary frame;

a reciprocally movable sewing machine movable between an operating position corresponding to the belt strip reeled on said guide surface and a waiting position behind it, said sewing machine having a sewing unit;

a rubber mounting mechanism to insert a waistband outside the cloth retained in a hoop shape and a stretched state;

a first cloth edge folding-over mechanism to fold over a cloth edge of the cloth retained in a hoop shape outside the waistband; and a second cloth edge folding-over mechanism to fold over again a cloth edge of the part already folded over by said first cloth edge folding mechanism before said sewing unit set at said operating position, and to press it between the waistband and the cloth.

2. The waistband sew-in device of claim 1, wherein the take-up and rewinding mechanisms comprise: a first take-up and rewinding mechanism having a first reel always thrust in a direction to rotate said belt strip, a first feed roller, and means to rotate said first feed roller to transfer the belt strip in said first reel by rotation intermittently in a direction to take up the belt strip in synchronization with the cloth feed mechanism of the sewing machine and to send out the belt strip from said reel by rotation continuously in a direction to rewind the belt strip; and a second take-up and rewinding mechanism comprising a second reel always thrust in a direction to rotate said belt strip, and a second feed roller to sent the belt strip into said second reel when the belt strip is let off by said first feed roller, by applying a feed force on the belt strip in the rewinding direction in cooperation with the first feed roller, and by rotation in the take-up direction following the belt strip when the belt strip is fed in the take up direction, by applying a torque in the rewinding direction on the belt strip.

3. The waistband sew-in device of claim 1, wherein the rubber mounting mechanism has a movable frame reciprocally movable outside said stationary frame, a pair of rubber support pins mounted on the movable frame on each side of said stationary frame, and means to move the support pins toward and away from each other in the vertical direction at each side of said stationar frame.

4. The waistband sew-in device of claim 1, further comprising a movable frame reciprocally movable outside of said stationary frame wherein said first cloth edge folding-over mechanism is mounted on said movable frame and comprises a hook capable of pinching and releasing the cloth edge of the hook shaped cloth and a driving mechanism to move the hook closer to or further from said stationary frame.

5. The waistband sew-in device of claim 1, wherein said second folding-over mechanism comprises a first guide piece to guide a desired position of the cloth, in which the waistband is inserted, into a direction to draw it apart from said folded-over part when an overlapped part of a folded-over part folded over by said first folding-over mechanism is sent to said sewing unit, and a second guide piece to introduce the cloth edge of said folded-over part between said cloth and the waistband while gradually folding it over.

6. The waistband sew-in device of claim 4, wherein the part left unfolded by the first cloth edge folding-over mechanism is in two plies and is eliminated by blowing an air jet against the unfolded part.

* * * * *

UNITED STATES PATENT AND TRADEMARK OFFICE

CERTIFICATE OF CORRECTION

PATENT NO. : 4,860,676

DATED : August 29, 1989

INVENTOR(S) : Kawai et al

It is certified that error appears in the above-identified patent and that said Letters Patent is hereby corrected as shown below:

Claim 2, column 10, line 32, change "sent" to --send--.

Signed and Sealed this

Twenty-first Day of August, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,860,676

DATED : August 29, 1989

INVENTOR(S) : Kawai et al

It is certified that error appears in the above-identified patent and that said Letters Patent is hereby corrected as shown below:

Claim 2, column 10, line 37, change "take up" to --take-up--.

Claim 3, column 10, line 46, change "nar" to --nary--.

Signed and Sealed this

Nineteenth Day of May, 1992

*Attest:*

DOUGLAS B. COMER

*Attesting Officer*

*Acting Commissioner of Patents and Trademarks*